United States Patent [19]

Kaiser

[11] Patent Number: 4,467,972

[45] Date of Patent: Aug. 28, 1984

[54] METHOD OF WINDING CLOSED CORES, ESPECIALLY RING CORES FOR ELECTRICAL COILS, AND DEVICE FOR PERFORMING THE METHOD

[75] Inventor: Jürgen Kaiser, Regensburg, Fed. Rep. of Germany

[73] Assignee: Siemens Aktiengesellschaft, Berlin and Munich, Fed. Rep. of Germany

[21] Appl. No.: 392,800

[22] Filed: Jun. 28, 1982

[30] Foreign Application Priority Data

Jun. 29, 1981 [DE] Fed. Rep. of Germany ..... 3125483

[51] Int. Cl.[3] ..... H01F 41/08

[52] U.S. Cl. ..... 242/4 R; 29/605

[58] Field of Search ..... 242/4 R, 4 A, 7.03, 242/7.02, 47, 53; 29/605

[56] References Cited

U.S. PATENT DOCUMENTS 2,820,598 1/1958 Aveni ..... 242/4 R
2,891,735 6/1959 Müller ..... 242/4 R
2,959,366 11/1960 Grant et al. ..... 242/4 R
3,050,266 8/1962 Bucalo ..... 242/4 A

FOREIGN PATENT DOCUMENTS 4414263 8/1965 Japan ..... 242/4 R
44791 8/1961 Poland ..... 242/4 R

*Primary Examiner*—Stuart S. Levy
*Assistant Examiner*—Thomas R. Hannon
*Attorney, Agent, or Firm*—Herbert L. Lerner; Laurence A. Greenberg

[57] ABSTRACT

Method of forming windings on a closed core, preferably a ring core, for electric coils which includes guiding by action of a magnetic field a magnetizable needle fastened to a starting end of a winding wire along a closed continuous travel path extending partly through an aperture in the core so as to wind the winding wire on the core, the closed continuous travel path decreasing in length with duration of winding of the winding wire on the core.

7 Claims, 8 Drawing Figures

METHOD OF WINDING CLOSED CORES, ESPECIALLY RING CORES FOR ELECTRICAL COILS, AND DEVICE FOR PERFORMING THE METHOD

The invention relates to a method of winding closed cores, especially ferrite ring cores, for electrical coils, as well as a device for performing the method.

German Published Non-Prosecuted Application (DE-OS) No. 28 20 674 describes a ring-core coil winding device with a ring core mounting, an annular magazine extending through the ring core aperture and carrying rotatably mounted rollers for wire guiding and magazining or storing, the ring core and the magazine being rotatable about the rotationally symmetrical axes thereof which are preferably aligned perpendicularly to each other, with a wire feed and with an element secured against rotation for fixing the starting end of the wire. The magazine of this heretofore known winding device has an interruption in a region along the length thereof.

The ring core can be wound even when the magazine is being filled. After the magazine has been filled with the required amount of wire, the wire is separated or severed from the supply reel, and the free wire end is pulled trailingly along during further winding. Opening of the magazine at the start and end of the winding process is eliminated. It is sufficient simply to insert the wire. Separate magazining or depositing of the wire in the magazine is no longer necessary, the otherwise required manipulations being thereby decreased considerably. Because the winding proceeds even while the wire is being deposited into the magazine with this heretofore known device, the net winding time as well as the number of turns for loading the magazine are reduced. The reduced number of turns for magazine loading, in turn, affords processing of the ring core coils with relatively small "residual holes", because magazines with smaller cross section can be used.

Very small ring cores i.e. ring cores in the order of magnitude of ≧16 mm ring-core outer diameter, cannot be wound, however, with winding devices of this type. Insofar as winding devices for this purpose are known, they are equipped with ring magazines having sliders or magazine rings, depending upon the wire gauge and the "residual hole of the ring core". The handling of these heretofore known winding devices is complicated and, with decrease in size of the residual hole, requires considerable "finger-tip feel" or instinct. In any case, the magazine must be loaded before the winding begins, for which reason winding is often performed by hand for economic reasons even when, technically, a ring magazine might yet be insertable.

It is an object of the invention to provide a method which is suitable, at least, for semiautomatic winding of small ring-core coils, for example, in the order of magnitude of ≧16 mm ring-core outer diameter. In addition, it is an object of the invention to provide a device for performing this method, which operates as free of disturbances as possible and at the lowest possible cost.

With the foregoing and other objects in view, there is provided, in accordance with the invention, a method of forming windings on a closed core, preferably a ring core, for electric coils which comprises guiding by action of a magnetic field a magnetizable needle, such as a steel needle, for example, fastened to a starting end of a preferably stretched winding wire, along a closed continuous travel path or track extending partly through an aperture in the core so as to wind the winding wire on the core, the closed continuous travel path decreasing in length with increasing winding time i.e. duration of winding of the winding wire on the core.

In accordance with another mode, the method of the invention includes initially fastening the starting end of the winding wire to the needle, then, while passing the needle through the core aperture, drawing off from a winding wire supply reel a length of wire corresponding to that of a winding, severing the wire length from the supply reel and clamping the severed end of the winding-wire length, and thereafter performing the winding operation itself.

In accordance with a further mode, the method of the invention includes transporting a single magnet along a path parallel to the closed continuous travel path for guiding the needle along the latter.

In accordance with an added mode, the method of the invention includes, cyclically, and with consideration of the continuous travel path decreasing in length with duration of winding, switching on and stepping a closed chain of electromagnets extending parallel to the continuous travel path for guiding the needle by the action of the chain of electromagnets.

Also in accordance with the invention, there is provided a device for performing a method of forming windings on a closed core for electric coils comprising a plate-shaped winding-wire support of electrically and magnetically insulating material formed with a cutout for receiving therein a core to be wound, core rotating means operatively associated with the winding-wire support, a winding-wire supply reel disposed at a distance from the cutout together with a device for drawing off the winding wire from the supply reel along a lateral surface of the winding-wire support, wire clamping and severing means located between the cutout and the supply reel, a needle, means of fastening a starting end of the winding wire to the needle, and means located on a lateral surface of the wire support opposite the first-mentioned surface thereof for moving a magnetic field parallel to a closed continuous travel path for the needle so as to slide the needle through an aperture formed in the core, the magnetic field being guidable along a continuous travel path having a length decreasing with duration of winding of the winding-wire on the core.

In accordance with another feature of the device according to the invention, the magnetic field moving means comprises a single magnet located on the opposite lateral surface of the wire support and being movable along the continuous travel path of the magnetic field.

In accordance with a further feature of the invention, the magnetic field moving means comprise a closed chain of electromagnets disposed on the continuous travel path of the magnetic field parallel to the continuous travel path of the needle, the electromagnets being switchable on and off consecutively in direction of travel of the needle.

In accordance with an added feature of the invention, the closed continuous path of the needle is formed of two partly parallel partial paths of opposite travel direction of the needle, the partial paths being connected to one another at respective reversal points, and the magnetic field moving means comprising a chain of electromagnets being moved forward and backward between and transversely to the partial paths in rhythm with the forward and backward moving needle.

In accordance with yet another feature of the invention, there are provided magnets disposed at the lateral surface of the support along which the winding wire is drawn off.

In accordance with yet a further feature, there is provided a separating brush disposed between the partial travel paths along which the needle moves forward and backward, the separating brush having bristles, the ends of which rest under light pressure on the lateral surface of the support along which the winding wire is drawn off.

In accordance with a concomitant feature of the invention, the brush bristles are formed of plastic material.

Other features which are considered as characteristic for the invention are set forth in the appended claims.

Although the invention is illustrated and described herein as embodied in a method of winding closed cores, especially ring cores for electrical coils, and device for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
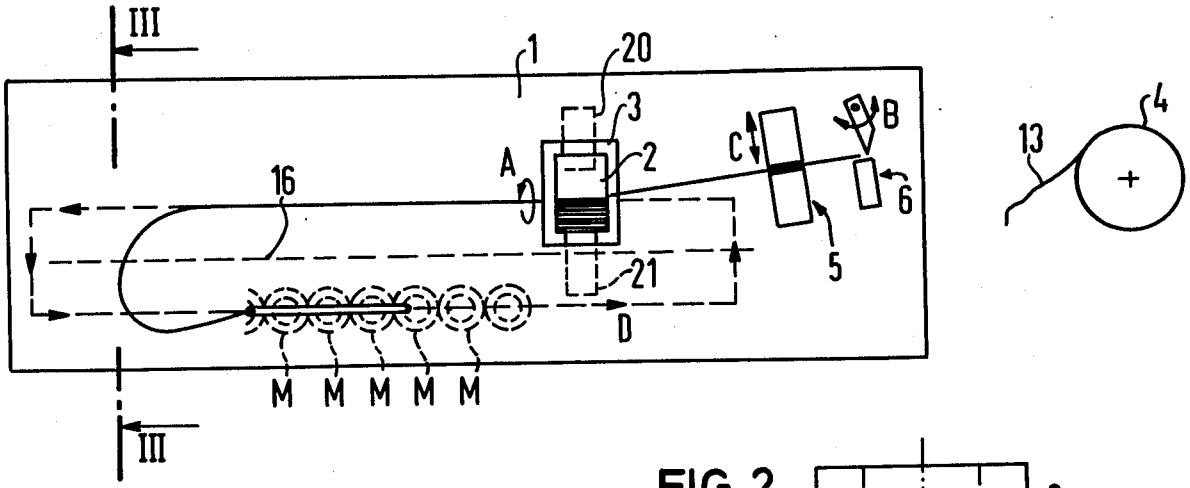
FIG. 1 is a diagrammatic top plan view of an embodiment of a winding device according to the invention.
Figure 2:
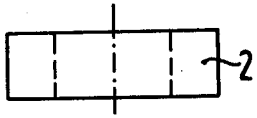
FIG. 2 is an enlarged fragmentary side elevational view of FIG. 2 showing a ring core thereof, and especially a ferrite ring core.

Referring now to the drawing and first, particularly, to FIG. 1 thereof, there is shown a rectangular and plate-shaped winding wire support 1 of electrically and magnetically insulating material, such as a suitable plastic material, for example. The winding wire support 1 has a rectangular perforation or cutout 3 for receiving therein a ring core 2 shown also in FIG. 2. The ring core 2 is rotated, during operation, in direction of the arrow A by an only partly illustrated core-rotating device formed of three rollers, two of which, namely, rollers 20 and 21 being shown. Spaced from the winding wire support 1 is a supply reel 4 wound with wire 13. In addition, a wire-cutting device 6 swingable in direction of the double-headed arrow B, and a wire clamping device 5 movable in direction of the double-headed arrow C are disposed between the supply reel 4 and the cutout 3.

Figure 3:
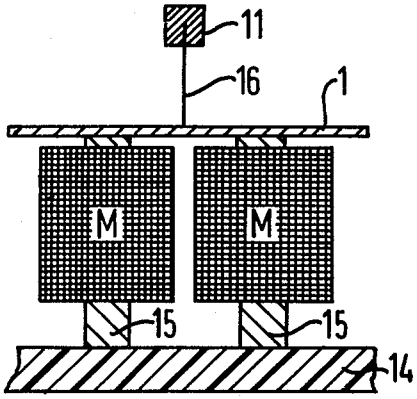
FIG. 3 is an enlarged sectional view of FIG. 1 taken along the line III—III in direction of the arrows.
Figure 4:
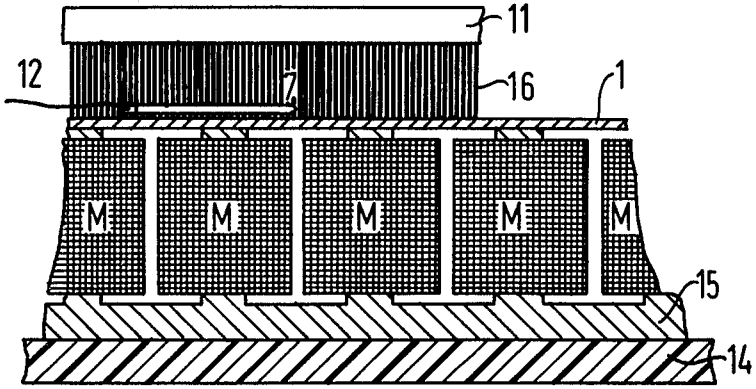
FIG. 4 is a fragmentary enlarged longitudinal sectional view of the device according to FIG. 1.

On the lateral surface of the winding-wire support 1 facing away from the wire clamping and cutting devices 5 and 6, respectively, a closed chain of electromagnets M is arranged along a continuous closed travel path, represented by a broken line and by arrows D, of a needle, the electromagnets M being switchable on and off consecutively or repetitively in desired manner by a conventional non-illustrated electric circuit. Transformer laminations or core plates 15, and a base plate 14 of insulating material, such as plastic material, especially, are shown in FIGS. 3 and 4. As seen in the longitudinal direction of the winding-wire support 1 and, in fact, intermediate the continuous closed travel path, of a needle 7, as represented by the arrows D, a separating brush 11 is disposed preferably having thin bristles 16 of plastic material which rest under light pressure, on the winding-wire support surface 1.

The manner of operation of the device shown in FIGS. 1 to 14 is as follows:

The ferrite core 2 which is to be wound is initially clamped into the core-rotating device in a conventional manner; then, the wire 13 is introduced into the eye of the steel needle 7 and knotted or tied manually or by means of a non-illustrated needle-threading device. The steel needle 7 together with the wire 13 is placed upon the winding-wire support 1 and is drawn through the ring core 2 under the action of a magnetic field produced by the electromagnets M. After the length of wire required for the winding is attained, the wire drawn from the supply reel 4 is severed by the cutting device 6 and the severed end thereof is clamped tight by means of the wire clamping device 5.

To transport the steel needle 7 together with the wire, the electromagnets M, as mentioned hereinbefore, are switched on and off in direction of the arrow D representing the continuous closed travel path, the steel needle 7 being drawn, so to speak, from electromagnet M to electromagnet M. In the "return course" of the magnetic field on the opposite leg or track of the travel path, the steel needle 7 jumps to the side of the opposite track and is taken along or entrained to the forward reversing point which is adjacent the ferrite ring core 2. There, the steel needle 7 jumps to the track or path section leading through the ring core aperture.

With each turn around the ferrite ring core 2, the remaining length of wire is reduced.

Figure 5:
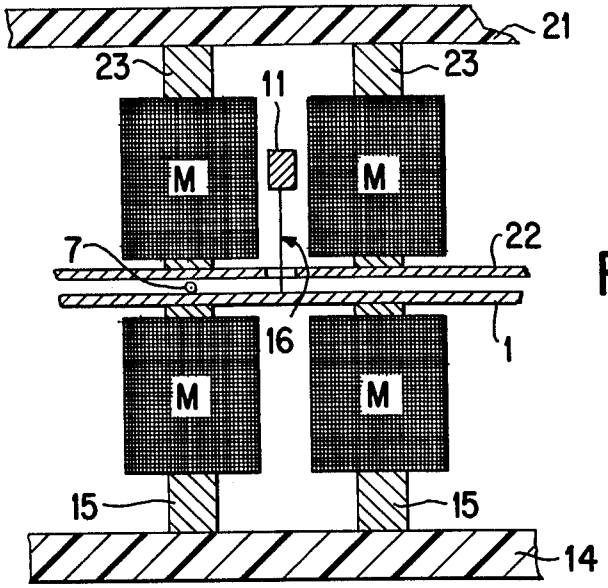
FIG. 5 is an enlarged sectional view of a second embodiment of a winding device according to the invention.

The electromagnets M are addressed, for example, via "ring counters", stepping mechanisms and the like. To align the steel needle 7 in direction of the continuous closed travel path, it is advisable to generate weaker "guiding fields", adjacent the respective, current-carrying electromagnet M, indeed by correspondingly smaller currents through these adjacent electromagnets M. If the magnet track is shortened with increasng winding time by control devices, the total winding time can be shortened considerably. To increase the stress or pressure acting on the steel needle 7, additional magnets M, as shown in FIG. 5, may be disposed above the support surface 1 of the winding wire 13 and above a further plate 22 of insulating material, which is provided with a longitudinal slot for the bristles 16 of the separating brush 11. The said magnets may be fixed for instance via transformer laminations or core plates 23 to a base plate 21 of insulating material.

The steady alignment of the steel needle 7 in winding direction is possible, for example, by appropriate formation of the magnetic field i.e., for example, by means of comb-like interleaved poles of the electromagnets.

The separating brush 11, the ends of the bristles 16 of which rest lightly on the support surface 1 of the winding wire, prevents undesired loop formation which may lead to knot formation.

Figure 6:
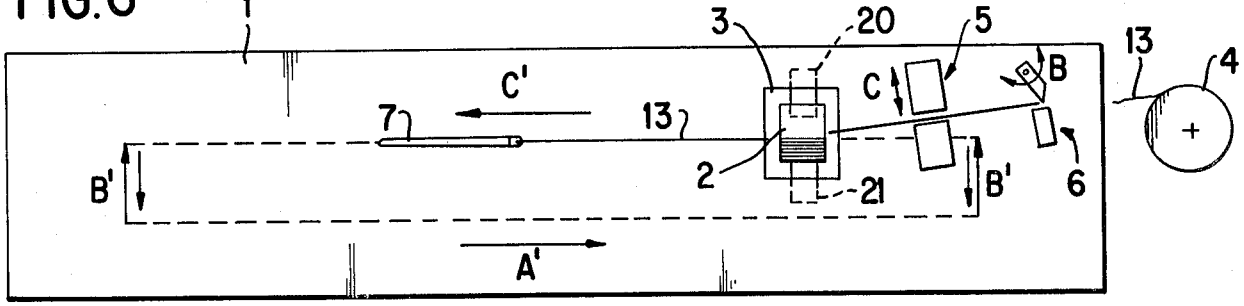
FIG. 6 is a diagrammatic top plan view of a third embodiment of a winding device according to the invention.
Figure 7:
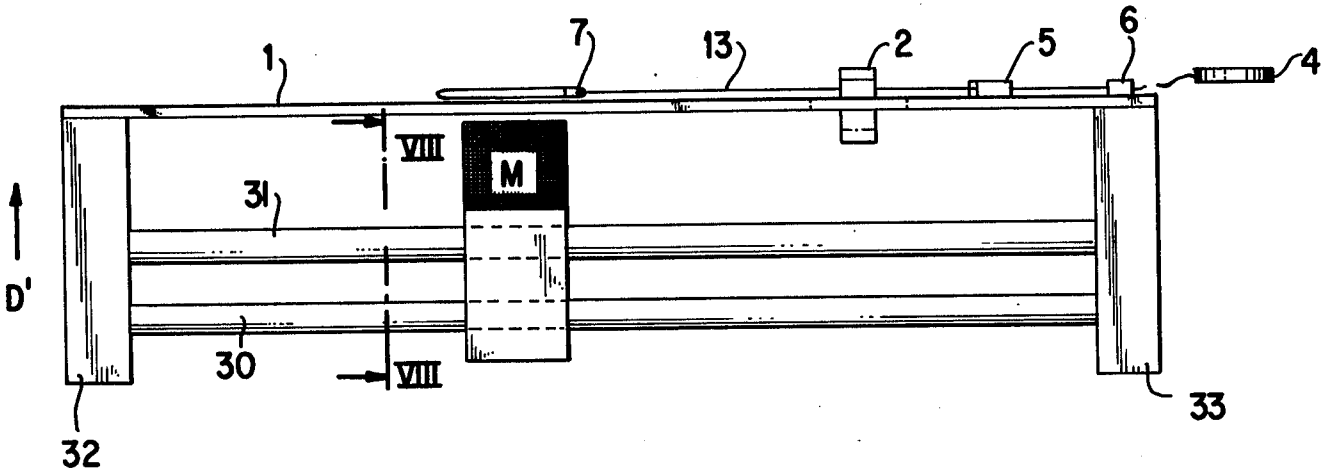
FIG. 7 is a diagrammatic side view of FIG. 6.
Figure 8:
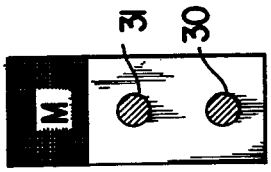
FIG. 8 is a fragmentary sectional view od FIG. 7 taken along the line VIII—VIII in direction of the arrows.

In the third embodiment of a winding device according to the invention, as shown in FIG. 6 to FIG. 8, the closed chain of electromagnets M is substituted by means of a pneumatic device. This device comprises two parallel rods 30, 31 supported by supporting means 32, 33, a single magnet M of permanent magnetic material and a holder for fixing the magnet M, which holder is provided with two holes penetrated by the rods, which are by means of special arrangements in the supporting means, (which are not shown in the drawing), movable in the direction of the arrows B', D'.

The winding process is as follows.

First the magnet is shifted by means of not shown transportation means in a starting position underneath the core 2. Second the magnet is moved in the direction of arrow C' till it comes to a stop close to the supporting means 32. Thereupon the rods 30, 31 are shifted in the direction of the arrows D, and the magnet starts to move in the direction of the arrow A' till it comes again to a stop close to the supporting means 33. In this position the rods 30, 31 are shifted in the direction of the arrows B', whereupon the magnet is again moved in the direction of the arrow C'. The magnet and the needle 7, which is drawn by the magnet, run as often along the above mentioned path as the winding of the core 2 is finished, whereas the path of the needle is reduced from turn to turn.

There are claimed:

1. Method of forming windings on a closed core for electric coils which comprises initially fastening the starting end of a winding wire to a magnetizable needle; then passing the needle through an aperture formed in the core and, simultaneously, drawing off from a winding-wire supply reel a length of wire corresponding to that of a winding; severing the wire length from the supply reel and clamping the severed end of the winding-wire length; guiding the magnetizable needle fastened to the starting end of the winding wire, by action of a magnetic field, along a closed continuous travel path extending partly through the aperture in the core and rotating the core so as to wind the winding wire on the core, the closed continuous travel path decreasing in length with duration of winding of the winding wire on the core; and cyclically, and with consideration of the continuous travel path decreasing in length with duration of winding, switching on and stepping a closed chain of electro-magnets extending parallel to the continuous travel path for guiding the needle by the action of the chain of electromagnets.

2. Device for performing the method of forming windings on a closed core for electric coils, comprising a plate-shaped winding-wire support of electrically and magnetically insulating material formed with a cutout for receiving therein a core to be wound, core rotating means operatively associated with said winding-wire support, a winding wire supply reel disposed at a distance from said cutout together with a device for drawing off the winding wire from said supply reel along a lateral surface of said winding-wire support, wire clamping and severing means located between said cutout and said supply reel, a needle, means of fastening a starting end of the winding wire to said needle, a closed chain of electromagnets located on a lateral surface of said wire support opposite said first-mentioned surface thereof, and means for cyclically switching said electromagnets on in stepwise fashion for moving a magnetic field parallel to a closed continuous travel path for said needle so as to slide said needle through an aperture formed in the core, said magnetic field being guidable along a continuous travel path having a length decreasing with duration of winding of the winding-wire on the core.

3. Device according to claim 2 wherein said closed chain of electromagnets are disposed on said continuous travel path of said magnetic field parallel to the continuous travel path of said needle, said electromagnets being switchable on and off consecutively in direction of travel of said needle.

4. Device according to claim 2 wherein said closed continuous path of said needle is formed of two partly parallel partial paths of opposite travel direction of the needle, said partial paths being connected to one another at respective reversal points, and said electromagnets are moved forward and backward between and transversely to said partial paths in rhythm with the forward and backward moving needle.

5. Device according to claim 4 including a separating brush disposed between the partial travel paths along which said needle moves forward and backward, said separating brush having bristles, the ends of which rest under light pressure on the lateral surface of said support along which the winding wire is drawn off.

6. Device according to claim 5 wherein said brush bristles are formed of plastic material.

7. Device according to claim 2 including magnets disposed at the lateral surface of said support along which the winding wire is drawn off.

* * * * *